United States Patent [19]

Miller

[11] Patent Number: 4,807,125

[45] Date of Patent: Feb. 21, 1989

[54] MULTI-PURPOSE LAMP

[76] Inventor: Bruce Miller, 421 Hudson St., New York, N.Y. 10014

[21] Appl. No.: 170,610

[22] Filed: Mar. 10, 1988

Related U.S. Application Data

[63] Continuation of Ser. No. 919,875, Oct. 16, 1986, abandoned.

[51] Int. Cl.[4] ..... F21V 21/14; F21V 21/32

[52] U.S. Cl. ..... 362/250; 362/413; 362/418; 362/427

[58] Field of Search ..... 362/250, 427, 428, 413, 362/415, 414, 410, 418

[56] References Cited

U.S. PATENT DOCUMENTS 2,352,496 6/1977 Rose ..... 362/427
3,413,459 11/1968 Sonneman ..... 362/427
4,449,169 5/1984 Warshawsky ..... 362/427
4,680,677 7/1987 Ross ..... 362/250 X

FOREIGN PATENT DOCUMENTS 300565 4/1916 Fed. Rep. of Germany ..... 362/427

*Primary Examiner*—Ira S. Lazarus
*Assistant Examiner*—Richard R. Cole
*Attorney, Agent, or Firm*—Cohen, Pontani & Lieberman

[57] ABSTRACT

The present invention discloses a lamp for providing general and task illumination in a simple cost efficient manner. This is provided by the structure where one lamp designed to provide general illumination of a large area or room is movably connected to a pivotably positionable second lamp which provides directed illlumination in a limited area. The lamp for providing general illumination is fixed on an upwardly extending rod so that light from the lamp is directed upward. This structure allows for general room illumination and directed task illumination to be provided for in a single unit.

11 Claims, 4 Drawing Sheets

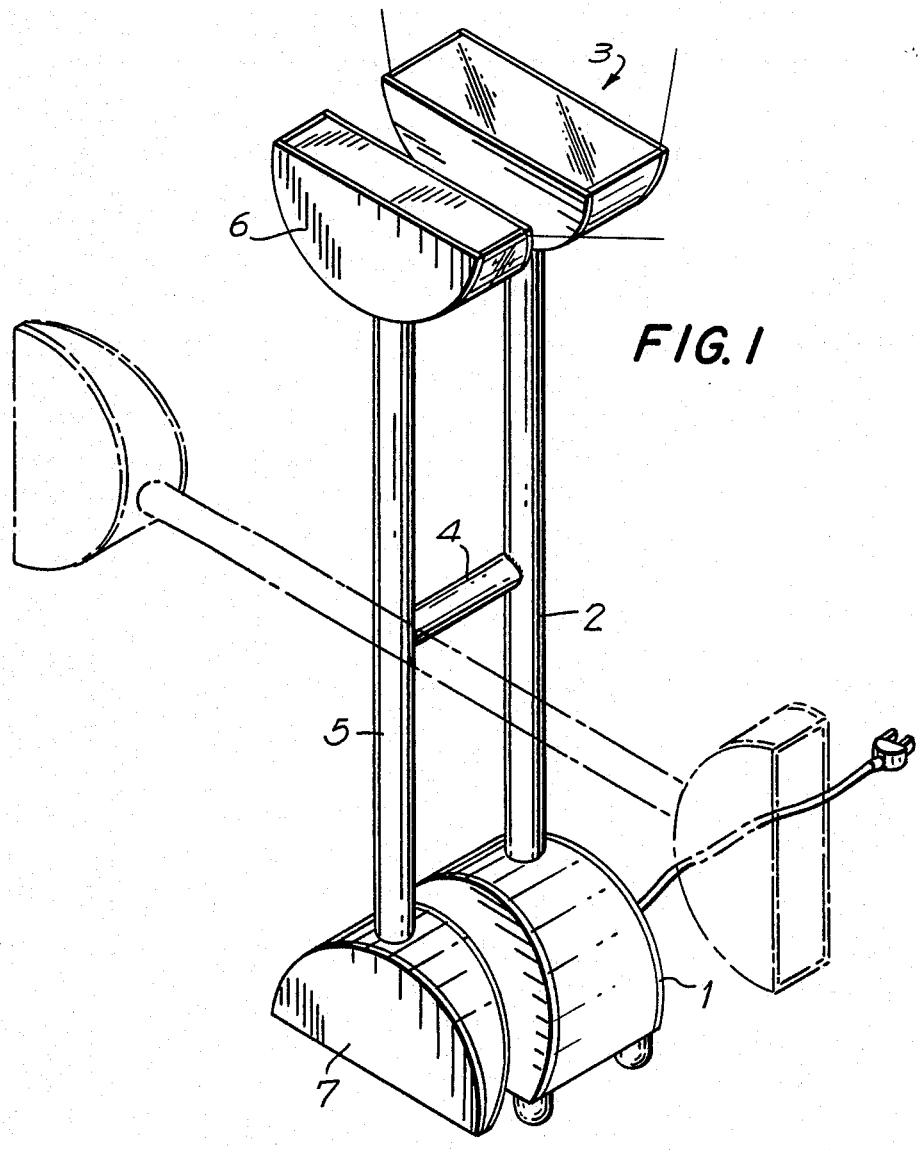
FIG. 1
FIG. 2
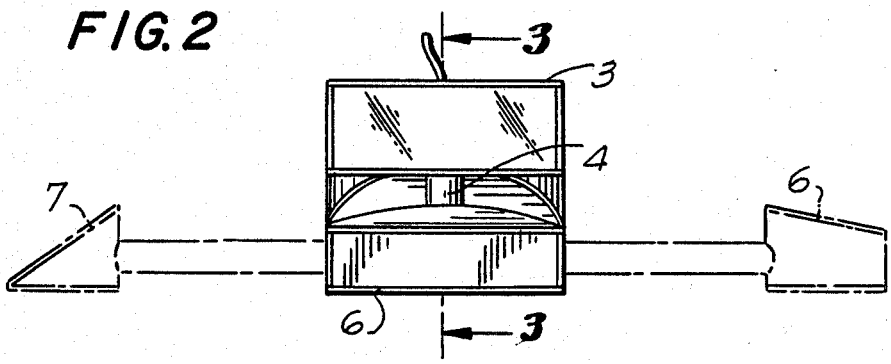

MULTI-PURPOSE LAMP

This is a continuation of U.S. application Ser. No. 919,875, filed Oct. 16, 1986, now abandoned.

TECHNICAL FIELD

The illumination of an entire area and the illumination of a work or reading area historically have been provided by two separate lighting units. Lamps have generally been constructed in a manner that is suitable for providing only one of these lighting needs. Overhead lamps or tradition pole lamp units do not provide sufficient directed illumination to adequately light an area where work or reading is done. Desk lamps and lamps that clamp to work areas are not constructed in a manner that general illumination is provided. The inflexibility of conventional lighting units is what the present invention addresses.

BACKGROUND OF THE INVENTION

The present invention relates to a lamp that provides both general illumination and task illumination. Conventional lamps provide for only one type of illumination, individual task illumination or general area lighting. To provide both task and general illumination requires the use of two separate lighting units in two separate structures. The present invention provides both general and task lighting while embodying only one structure. The illuminating means of the present invention is ideal for use wherever general and/or task lighting may be required and therefore has many more uses than any single prior illuminating means. In addition, the use of the present invention results in significant cost savings over prior lamps by providing for both of these lighting needs in one structure that can be easily produced.

SUMMARY OF THE INVENTION

A object of the present invention is to provide for task and general illumination in a single unit such that the necessity of employing two separate lighting units will be alleviated. In the present invention a single structure embodies both an adjustable task lighting means and a fixed general illuminating means. This structure satisfies all the lighting requirements of its user in an efficient and easily adjustable manner.

According to the invention there is provided a lamp with a base to which a rod-like member is vertically fixed at one end. A the top of the fixed vertical rod is a general illuminating means. The general illuminating means is preferably comprised of a lamp with a shade or casing that directs the light emitted from the lamp essentially upward. This provides for general illumination of the entire room or area.

The fixed rod is connected to a pivotal rod by the use of a cross member. The pivotal rod has fixed on one end a task illuminating means and on the other end a balancing means. The balancing means is preferably weighted and positioned in such a manner that the center of gravity of the pivotal arm coincides with the axis of the pivotal arm. The task illuminating member comprises a lamp with a shade or casing such that the light from the lamp is directed essentially downward and oblique when the pivotal arm is in a vertical position. This allows for light to be easily directed by imply changing the angular position of the pivotal rod to provide for direct illumination of work, reading or areas where direct illumination is required.

The object and novelty of the present invention is the unique method of satisfying both general and task lighting needs in one cost effective efficient structure. The unique structure that uses one fixed member which is used to provide general illumination connected to one pivotal counter balanced member achieves this desired result. This represents a significant advance over other known lighting means, none of which provides for task and general illumination as described in the current invention.

BRIEF DESCRIPTION OF THE DRAWINGS

FIG. 1 is an elevated perspective view of the present invention, dotted lines showing an alternate position of the task illuminating member;

FIG. 2 is a top plan view where dotted lines indicate an alternate position of task illuminating member;

DESCRIPTION OF THE PRESENTLY PREFERRED EMBODIMENTS

Figure 3:
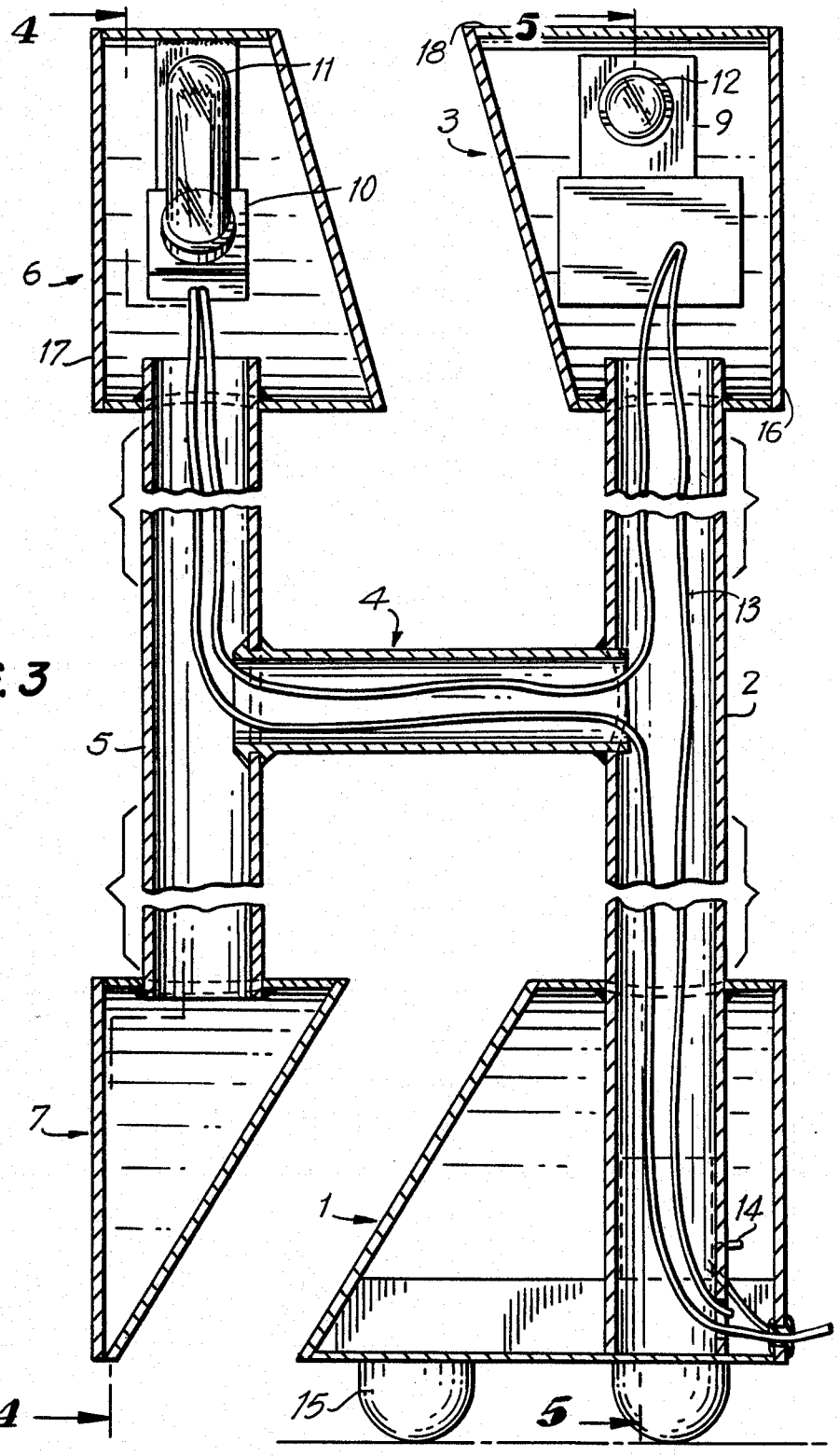
FIG. 3 is a sectional view along line 3—3 of FIG. 2.
Figure 4:
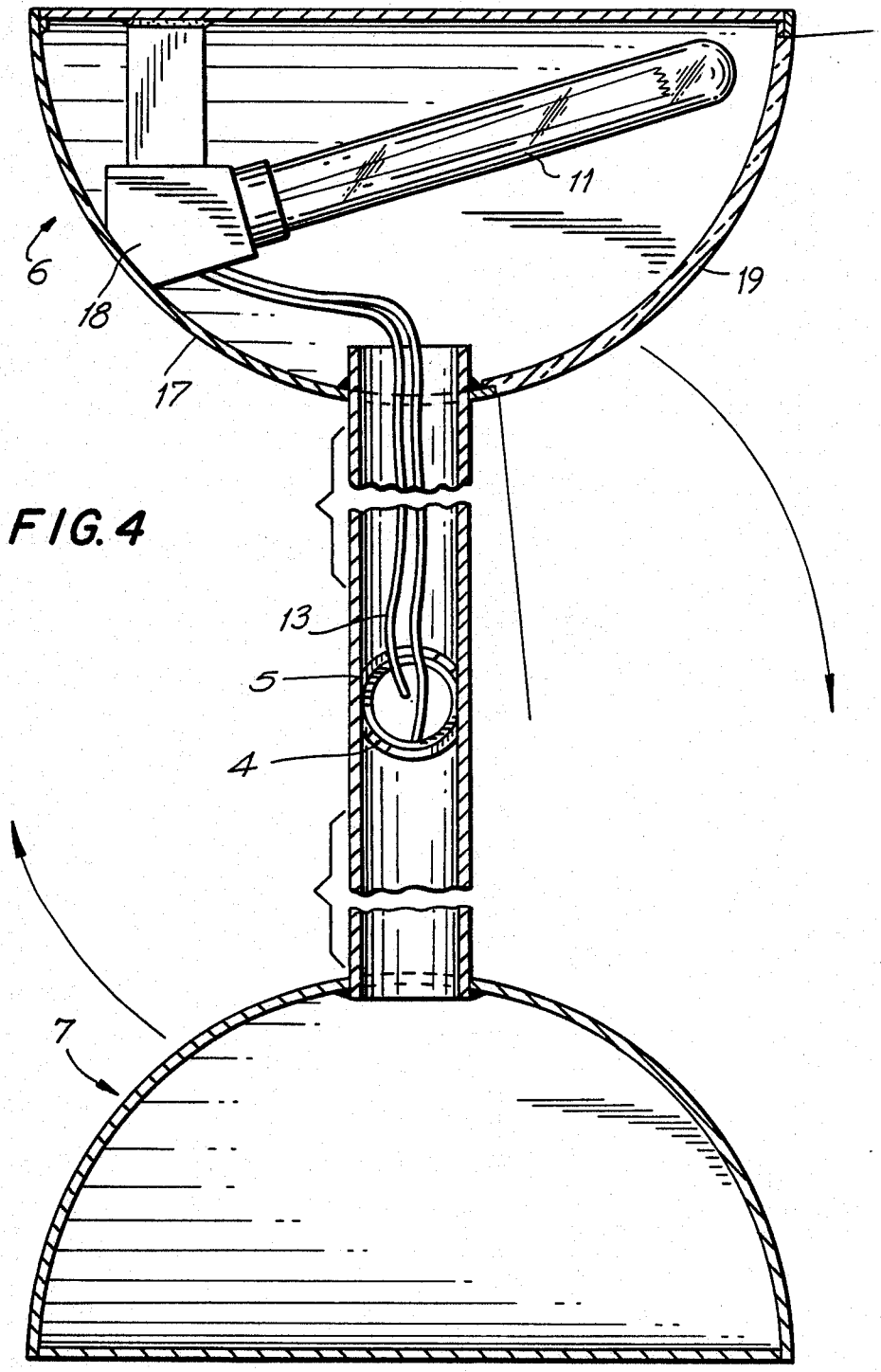
FIG. 4 is a sectional view along line 4—4 of FIG. 3.
Figure 5:
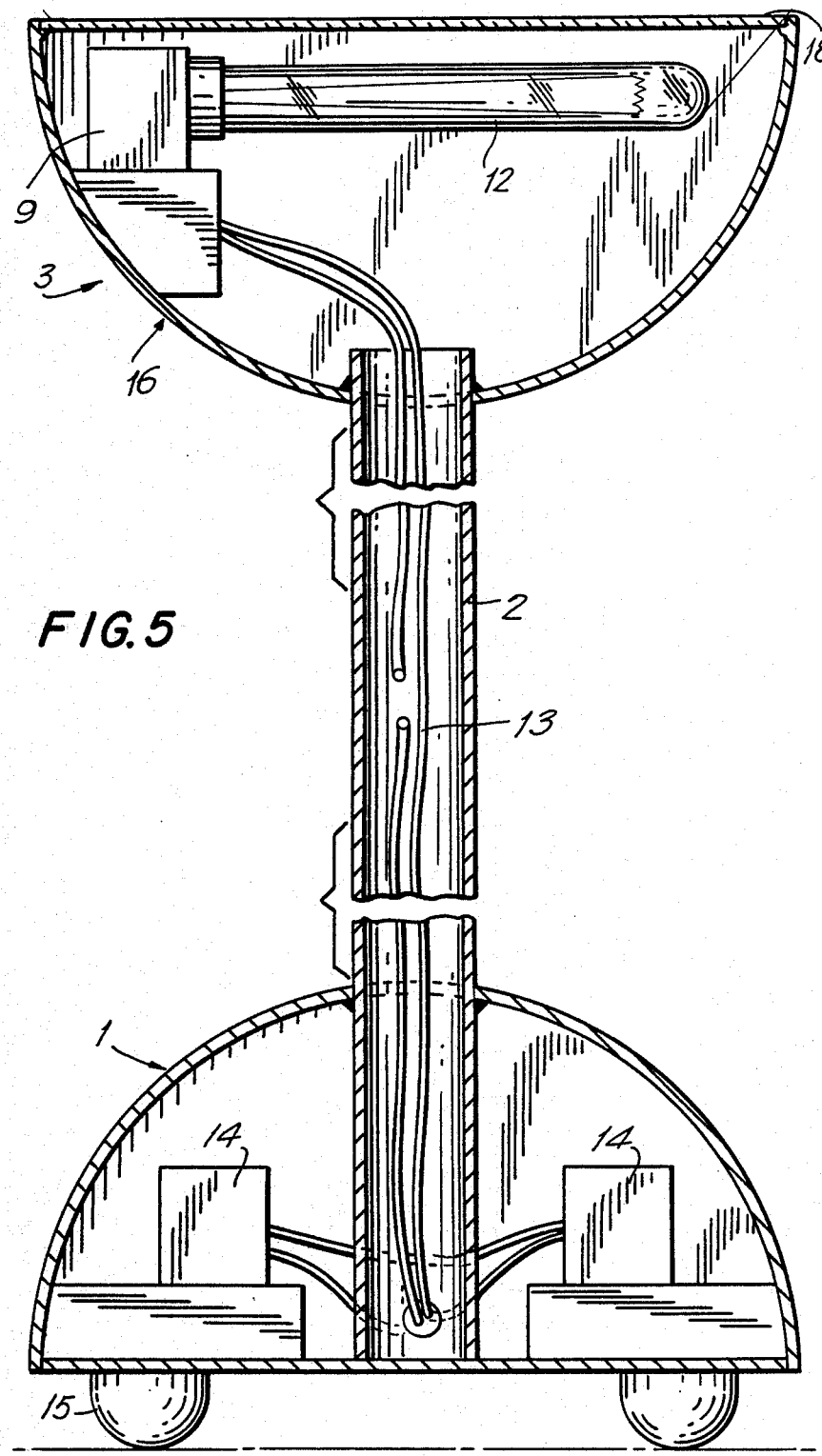
FIG. 5 is a sectional view along line 5—5 of FIG. 3.

The multi-purpose lamp of the present invention is achieved by the structure in which two rod-like members 5 and 2 are joined by a connecting member 4 in such a manner that rod member 5 is rotatable in a plane parallel to the other member 2. Rod member 2, at one end, is fixed to a support base 1. The other end of rod member 2 is fixed to an illuminating member 3. In the preferred embodiment, which is shown, the support base 1 is box-like and acts as a stand to support the lamp. It is contemplated, however, that other means for fixing the position of the lamp may be employed such as a clamp suitable for affixing the lamp to a work bench or drawing board, or an attachment suitable for fixing the lamp to ceilings or walls, etc. Connecting member 4 is fixedly attached to rod 2 between base 1 and illuminating member 3 such that it is essentially perpendicular to rod 2. Rotatably connected to connecting member 4 is rod member 5. On one end of rotatable rod member 5 is an illuminating member 6. On the other end of rod member 5 is a balancing member 7, although other counterbalancing means such as, for example, springs may be used. The balancing member 7 is so designed to enable the rotation of rod member 5, with the task illuminating means, circumferentially about connecting member 4 without shifting weight distribution. Of course, connecting member 4 may be rotatably connected to rod 2 and fixed to rod 5, or it may be rotatably connected to both rods 2 and 5.

Illuminating member 3 in the preferred embodiment as shown, comprises a box-like semicirclar casing 16 fixed to rod 2 such that a flat surface is on top of the casing, although, of course, other contours could be employed. In the box-like casing 16 a lighting means comprising a socket 9 and a bulb 12 are mounted such that light is directed essentially upward. The flat top surface 18 of the box-like semicircular casing 16 is light transmitting, preferably translucent to diffuse the general light from bulb 1 while permitting it to be directed essentially upward. The other sides of the casing 16 are opaque. Of course, other configurations for illuminating means 3 may be employed within the scope of this invention.

Illuminating means 6, in the preferred embodiment, comprises a box-like semicirclar casing 17 fixed to rod 5 such that a flat surface is on top and the semicircular surface is in direct contact with rod 5. A lighting means comprising a socket 10 and a bulb 11 is mounted in the box-like casing 17 of the preferred embodiment such that light is optimally (but not necessarily) directed obliquely to rod member 5. One face of the box-like casing 17, preferably the semicircular surface 19 from the point where it is fixed to rod 5 to the flat top surface, is light transmitting, preferably translucent. The remainder of casing 17 is preferably opaque.

To allow for the passage of wires from an electrical source to the lamp sockets 9 and 10, the rods 2 and 5 and connecting member 4 are preferably tubular and are joined in such a manner as to provide for internal communication through said tubes. Thus, tubular rod 2 opens into base 1 at one end and into the box-like casing 16 of the illuminating means 3 at the opposite end. Tubular rod 5 opens into the box-like casing 17 of illuminating means 6. In a preferred embodiment wires 13 are connected to lamp sockets 9 and 10 and to an electrical source (not shown) through switches 14 in base 1 so that each illuminating means may be controlled individually by the use of switches 14. Of course, other ways of controlling the energization of lamps 11 and 12 will readily suggest themselves and are intended to be within the scope of this invention.

In the preferred embodiment, base 1 rests on casters 15, although glides or feet may be used, or the base may rest directly on a supporting surface such as a table or floor. Plastics are preferably used to construct the tubes 2, 4 and 5 and the casings of the illuminating means 16, 17, the base 1 and weight 7. Other suitable materials, such as aluminum or other metals may be used without departing from this invention.

The present invention is intended to be used wherever general and/or task illumination is desired. To illuminate an entire area or room in a manner similar to that provided by an overhead lamp, the general illuminating member 3 of the present invention may be used. The light emanating from the general illuminating member 3 is such that an entire area will be illuminated without the need for additional lighting units. To provide individual directed illumination for lighting work or reading areas, the task illuminating member 6 may be used. The movable arm to which the task illuminating member 6 is fixed may be easily positioned to direct the light emanating from the lighting means of the task illuminating member 6 such that work or reading area is adequately illuminated. Naturally, the task and general illuminating members may be used individually or jointly as the lighting needs of the user dictate.

While I have herein shown and described a preferred embodiment of the invention and various modifications thereof, persons of ordinary skill in the art will recognize that other changes and modifications may be made therein without departing from the spirit and scope of the invention. Accordingly, the above description should be construed as illustrative, and not in a limiting sense, the scope of the invention being defined by the following claims.

What is claimed is:

1. A lamp for providing both general space and task lighting, which comprises: a support base; an upwardly extending rod mounted on said support base; a general illuminating member comprising a first lighting means, said general illuminating member being attached to said upwardly extending rod for directing light in a direction away from said lamp to provide general illumination of the space; a second rod; means for mounting said second rod in said upwardly extending rod for pivotal movement relative to said upwardly extending rod within a plane substantially parallel to said upwardly extending rod; and a task illuminating member comprising a second lighting means, said task illuminating member being attached to said second rod for providing illumination adjustably directed essentially in a limited area by movement of said second rod relative to said first upwardly extending rod.

2. The lamp according to claim 1, wherein said means for movably mounting said second rod on said upwardly extending rod is a pivot.

3. The lamp according to claim 2, wherein said pivot is attached to said second rod in the vicinity of the center of gravity thereof, whereby substantially balancing said second rod on said pivot.

4. The lamp according to claim 3, wherein said task illuminating member comprises a box-like case member connected to one end of said second rod and means for directing the light from said second lighting means of said task illuminating member in a direction essentially perpendicular to said second rod.

5. The lamp according to claim 4, wherein one surface of said box-like case member of said task illuminating member comprises a light transmitting means for transmitting light from said second lighting means essentially perpendicular to said second rod, the remaining surfaces of said box-like member of said task illuminating member being opaque.

6. The lamp according to claim 2, wherein said general illuminating member comprises a box-like case member connected to the upper end of said upwardly extending rod and means for directing the light from said first lighting means in an upward direction.

7. The lamp according to claim 6, wherein the top surface of said box-like case member of said general illuminating member comprises a light transmitting means for transmitting light from said lighting means essentially upward, the remaining surfaces of said box-like member being opaque.

8. The lamp according to claim 1, wherein said upwardly extending rod, said second rod and said means for movably mounting said second rod on said upwardly extending rod are tubular, said tubes being connected so that the interiors thereof communicate.

9. The lamp according to claim 8, wherein electric conductor means from an electrical power source is connected to said first and second lighting means, said electrical conductor means being disposed in the interiors of said tubular upwardly extending rod, said tubular second rod and said tubular means for movably mounting said second rod.

10. The lamp according to claim 9, further comprising switch means for controlling the flow of electrical current through said conductor means to said first and second lighting means.

11. The lamp according to claim 9, further comprising a first switch means for controlling the flow of electrical current to said first lighting means and a second switch means for controlling the flow of electrical current to said second lighting means.

* * * * *